US007213717B2

(12) United States Patent
Willim

(10) Patent No.: US 7,213,717 B2
(45) Date of Patent: May 8, 2007

(54) TELESCOPIC BOOM

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 70 days.

(21) Appl. No.: 10/732,765

(22) Filed: Dec. 10, 2003

(65) Prior Publication Data

US 2004/0129663 A1 Jul. 8, 2004

(30) Foreign Application Priority Data

Dec. 10, 2002 (DE) ..... 202 19 126 U

(51) Int. Cl.
*B66B 23/69* (2006.01)

(52) U.S. Cl. ..... 212/299; 52/148; 212/348

(58) Field of Classification Search ..... 212/298, 212/348, 118, 148, 299; 52/118, 148
See application file for complete search history.

(56) References Cited

U.S. PATENT DOCUMENTS

| | | | | |
|---|---|---|---|---|
| 763,222 | A | 6/1904 | Van Driessche | |
| 2,796,178 | A * | 6/1957 | Praschak | 212/225 |
| 2,905,280 | A * | 9/1959 | Weaver | 52/118 |
| 3,176,854 | A * | 4/1965 | Brown | 212/239 |
| 3,396,814 | A * | 8/1968 | Garnett | 182/2.5 |
| 3,477,522 | A * | 11/1969 | Templeton | 173/196 |
| 4,383,616 | A * | 5/1983 | Sterner et al. | 212/299 |
| 4,392,573 | A * | 7/1983 | Gyomrey | 212/230 |
| 4,498,263 | A * | 2/1985 | Bocker | 52/223.12 |
| 4,523,669 | A * | 6/1985 | Smith | 198/313 |
| 4,850,161 | A * | 7/1989 | McGinnis | 52/108 |
| 4,976,361 | A * | 12/1990 | Becker | 212/231 |
| 4,982,853 | A * | 1/1991 | Kishi | 212/231 |
| 5,597,078 | A | 1/1997 | Becker et al. | |
| 5,799,807 | A * | 9/1998 | Hamme | 212/299 |
| 5,803,279 | A * | 9/1998 | Stallbaumer et al. | 212/299 |
| 6,186,347 | B1 * | 2/2001 | Reifenscheid et al. | 212/300 |
| 6,481,587 | B2 * | 11/2002 | Higgins | 212/298 |
| 6,550,624 | B1 * | 4/2003 | Irsh et al. | 212/299 |

FOREIGN PATENT DOCUMENTS

| | | |
|---|---|---|
| DE | 22 58 807 | 6/1974 |
| DE | 84 11 406 | 5/1985 |
| DE | 200 02 179 | 8/2000 |
| DE | 200 02 748 | 8/2000 |
| DE | 100 22 658 | 3/2001 |
| DE | 100 84 263 | 4/2002 |
| DE | 200 20 974 | 4/2002 |
| DE | 101 29 022 | 1/2003 |
| EP | 1 213 254 A1 * | 6/2002 |

* cited by examiner

*Primary Examiner*—Thomas J. Brahan
(74) *Attorney, Agent, or Firm*—Dilworth & Barrese LLP

(57) ABSTRACT

The within invention concerns a telescopic boom of a crane with a pivot section, telescopic sections that can telescope out of the pivot section, and a guying that has at least one guy stand housed to pivot on one of the sections, and at least one guy cable supported by the guy stand, as well as erection mechanisms for raising the support stand out of folded transportation position into raised operating position. According to the invention, the telescopic boom is characterized by the fact that the erection mechanism consists of a tension rod that connects the guy stand with an internal telescopic section that can telescope outward opposite the section on which the guy stand is housed to pivot.

22 Claims, 5 Drawing Sheets

TELESCOPIC BOOM

BACKGROUND OF THE INVENTION

The within invention concerns a telescopic boom of a crane with a pivot section, telescopic sections that telescope out of the pivot section, and a guying that has at least one guy stand housed to pivot on one of the sections, at least one guy cable supported on the guy stand, and erection equipment for raising the guy stand from its transportation position, folded against the boom, into raised operating position.

Telescopic booms have become known in which the guy stand consists of two guy supports that can be opened out into a V when in operating position (cf. DE 100 22 658 A1). The guy supports are pivoted on a swivel frame that is attached in such manner that it can swivel on top of the pivot section. The guy supports can be raised by swiveling the swivel frame. Additionally, the guy supports can be swiveled relative to the swivel frame so that they can be pressed open into a V. The guy supports are raised and opened out by means of an appropriate hydraulic cylinder. To supply the hydraulic cylinder easily with hydraulic fluid and to allow it to pivot at an appropriate distance from the swivel axle of the guy stand, the guy stand must be positioned on the pivot section. If the guy stand were attached to one of the telescopic sections, a tubular drum would be necessary.

SUMMARY OF THE INVENTION

It is therefore the task of the within invention to create an improved telescopic boom, of the type initially described, that avoids the disadvantages of the state of the art and improves on said state of the art in an advantageous manner. Preferably, an improved arrangement of the guy stand is to be created that supports heavy loads and permits easy raising of the guy stand into its operating position.

The task is performed according to the invention by a telescopic boom described herein. Preferred embodiments are also the subject herein.

According to the within invention, the lifting mechanisms for raising the guy stand into its operating position consist of a tension rod that links the guy stand with an internal telescoping section that can telescope out opposite the telescoping section on which the guy stand is housed to pivot. When the boom telescopes out, that is, when the aforesaid internal telescoping section on which the tension rod is pivoted moves outward, the guy stand is automatically lifted from the tension rod. The lifting mechanisms can be designed to be independent of power lifts operated by outside energy. A pressure cylinder is not necessary in order to raise the guy stand.

In a further development of the invention, the tension rod raises the guy stand only far enough that the guy stand is inclined in its operating position in such manner that the force resulting from the guy cable acting on the guy stand has a lever arm with respect to the pivot point of the guy stand, which said lever arm creates a tractive force in the tension rod. In its operating position, the guy stand is not precisely in the line of action of the resulting force of the guy cable on the guy stand; rather, it is inclined at a sharp angle of preferably less than 30°, so that the resulting force of the guy cable tries to push the guy stand back into its transportation position. However, the tension rod prevents this. The guy stand itself can be unbolted at its joint. In its operating position it is kept stable by the tractive force of the tension rod and by the resulting force of the guy cable which are in balance with respect to the swivel axle of the guy stand.

Advantageously, the guy cable is not attached to the guy stand; preferably, it is instead merely turned around by means of a deflection roller and runs out over the guy support from a catch point on the collar of one of the internal telescoping sections to a catch point on an external telescoping section. Appropriately, the guy cable is fastened on the one hand to the collar of the innermost telescoping section and on the other hand to the bottom of the pivot section. The guy stand serves merely to turn the running guy cable around.

The guy stand is pivoted preferably not on the collar of the pivot section but rather on the collar of a center boom section. Theoretically the guy stand can be pivoted on any collar of the telescopic boom. Preferably, however, the guy stand sits on the collar of the first telescopic section held directly in the pivot section. In this way a considerable increase in tractive force can be achieved, compared to a guying with a guy stand positioned on the pivot section.

According to another preferred embodiment of the invention, several guy stands can be also be positioned on several boom sections. In an appropriate arrangement, a first guy stand sits on the first telescopic section held in the pivot section, and a second guy stand sits on one of the telescopic sections farther inside that are able to telescope outward relative to the said first telescopic section, preferably the second telescopic section.

The tension rod that raises the guy stand in question and holds it in operating position can theoretically be attached to various telescopic sections that are positioned farther inside in comparison to the telescopic section on which the guy stand sits. Preferably, however, the tension rod is pivoted on the collar of the immediately adjacent telescopic section, which is held directly in the telescopic section on which the guy stand is pivoted. The result is that the tension rod needs to be adjusted to the movement of only one telescopic section. Erection then occurs even if the next but one telescopic section is not telescoped outward.

In a further development of the invention, the length of the tension rod can be adjusted to facilitate adjustment to various extension positions of the telescopic boom. Advantageously, the tension rod can exist of a telescopic pipe that can be locked in several extension lengths.

The guy stand can theoretically consist of just one guy support that is positioned in the luffing plane of the telescopic boom and can pivot. However, in order to protect against lateral forces, particularly as the result of wind or cross-velocities, the guy stand consists preferably of two guy supports, each pivoted in such manner that in their operating position they are spread out in a V shape. In this case the guying consists of two guy cables, each of which supports one of the guy supports. The guy supports are preferably housed to pivot in such manner that in transportation position they are folded on the boom in essentially parallel positions. Preferably they can swivel on only a single swivel axle that is inclined toward the luffing plane of the boom. The guy supports do not have to be linked. Preferably, each of the guy supports is connected with a tension rod by means of which the guy supports can be raised synchronously.

In a further development of the invention, the guy cable or each guy cable can be drawn out of or into a cable storage device and can be locked by means of a hook and eye in such manner that it can be pulled out of this cable storage device. In theory a frictional hook and eye can be provided. Preferably, however, a positive-acting hook and eye is provided. At the end of each guy cable there can be several thickening pieces, in particular cable clamps clamped on the guy cable, which said cable clamps can engage positively with the hook and eye. On the one hand, by means of such a hook and eye and the corresponding elimination of a heavy cable coil that can accept the guy cable forces, the corresponding expensive coils and the heavy construction resulting therefrom can be avoided. Additionally, the problems of a frictional cable clamp, in particular a change in clamp effect because of a change in the friction coefficients during operation, can be eliminated.

Preferably the guy cable can be locked in several predetermined lengths by means of the hook and eye. Each guy cable can have several thickening pieces positioned at intervals, and the guy cable can have a mobile locking piece that, depending on the position, can allow the guy cable with one or more thickening pieces to run through or can capture one of the thickening pieces.

In a further development of the invention, the hook and eye can be moved by means of a hook and eye drive, particularly a hydraulic cylinder, in the longitudinal direction of the cable, whereby the guy cable can be placed under tension. As soon as the hook and eye has captured one of the thickening pieces, the hook and eye can be moved by means of the hook and eye drive in order to prestress the guy cable. By means of the prestressing of the guy cable or the guy cables, the guying can be activated already at a very early stage, whereby the flection of the boom, particularly during the luffing operation, can be greatly reduced. This prevents a flection of the boom that would give a lever arm to the force components acting in the longitudinal direction of the boom, which said lever arm would according to the principle of the ejected strut activate a further ejection of the boom.

The hook and eye and/or the cable storage device are positioned preferably on the pivot section. The guy cable or each of the guy cables can be extended and retracted at its bottom pivot point and can also be locked in the designed length. The advantage of positioning the hook and eye and the cable storage device on the pivot section is that even if the guy stand is positioned on one of the inner telescopic sections no energy lines to one of the internal telescopic sections need to be laid in order to activate the hook and eye or the cable storage device.

As cable storage device at least one storage pulley can advantageously be provided, into which said storage pulley the guy cable or each guy cable can be drawn. Preferably a thin auxiliary cable is attached at the end of the guy cable, which said auxiliary cable is wound on an auxiliary coil and draws the guy cable into the storage pulley or is drawn into the storage pulley in place of the guy cable when the guy cable is drawn out. Needless to say, the auxiliary coil serves only to haul in the guy cable and does not capture the cable forces of the guy in operation. The operating forces are captured by the hook and eye.

BRIEF DESCRIPTION OF THE DRAWINGS

The invention is explained below in greater detail by means of two preferred embodiments and pertinent drawings that show.

DESCRIPTION OF THE PREFERRED EMBODIMENTS

Figure 1:
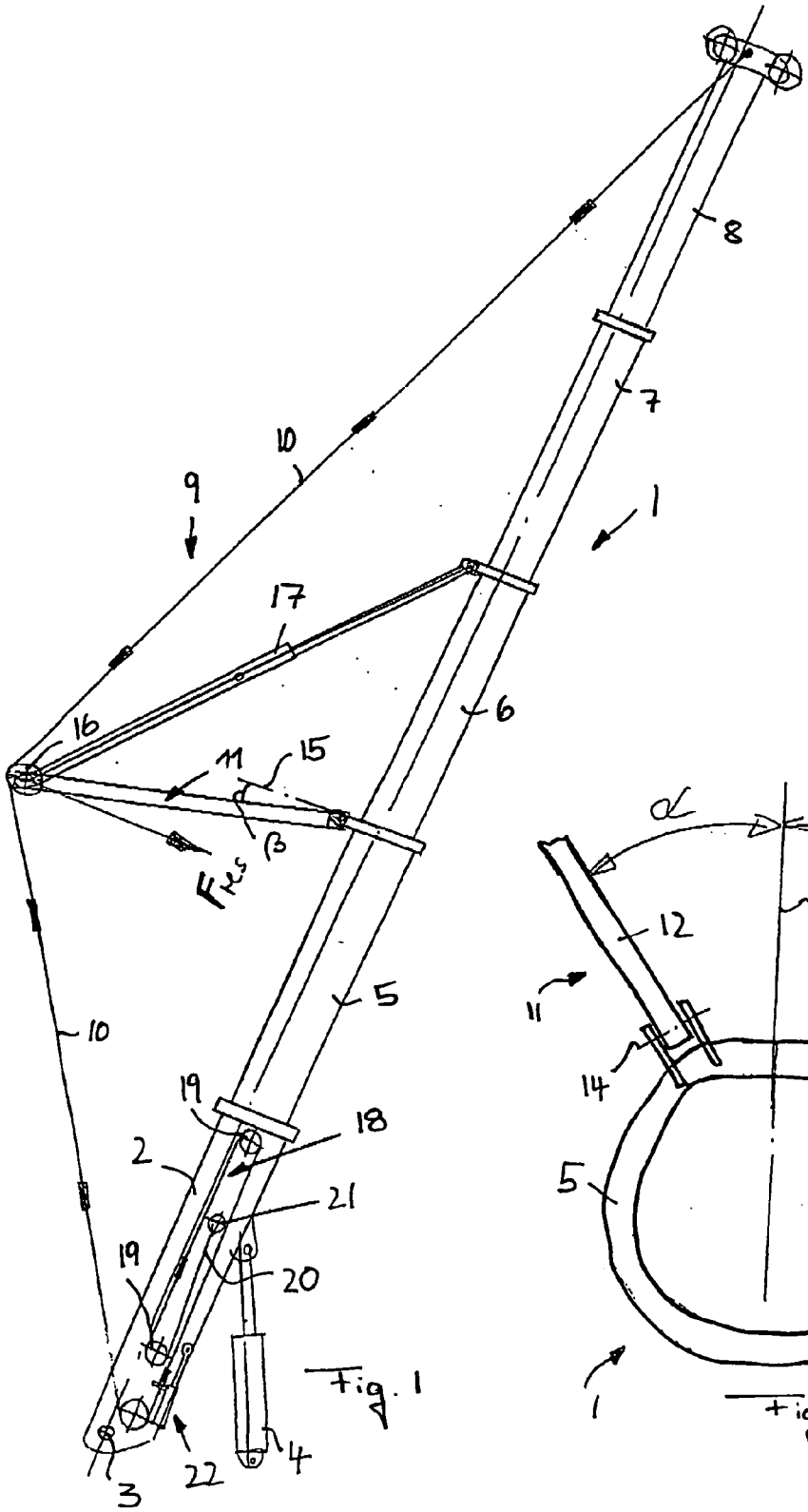
FIG. 1, a schematic side view of a telescopic boom with a guy stand housed on the first outward-telescoping telescopic section, according to a first preferred embodiment of the invention.

The telescopic boom 1 according to FIG. 1 includes a pivot section 2 that can be pivoted up and down on a horizontal luffing axle 3 in known manner by means of a luffing cylinder 4.

The telescopic boom 1 also includes four telescopic sections 5, 6, 7, and 8 that can be telescoped in and out of pivot section 2 or in and out of one another.

Figure 2:
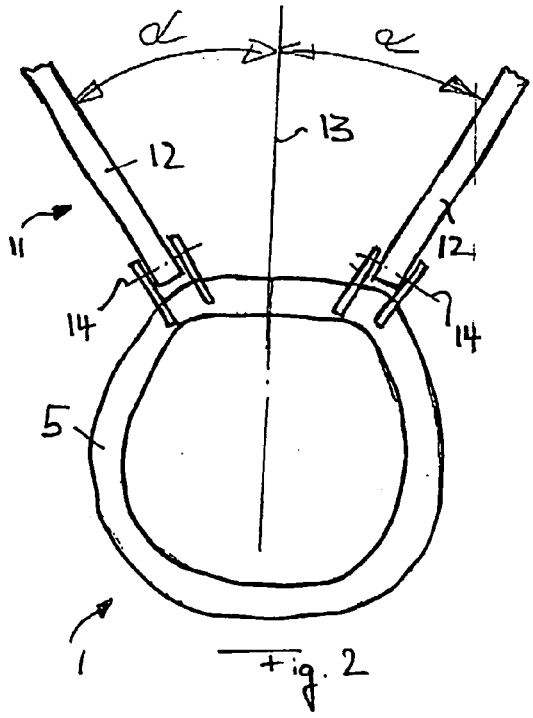
FIG. 2, a cross-section through the first telescopic section of the telescopic boom according to FIG. 1, which shows the V-shaped spread of the guy supports of the guy stand in its operating position.
Figure 3:
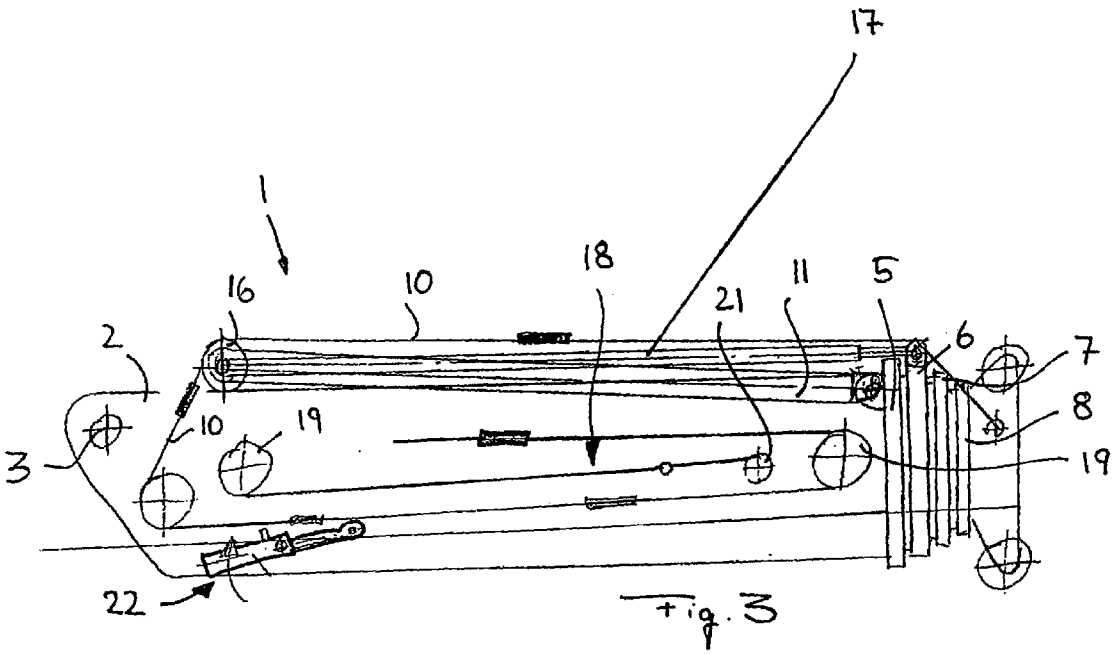
FIG. 3, a schematic side view of the telescopic boom according to FIG. 1 in transportation position, in which the guy stand is folded on the pivot section of the telescopic boom.

To guy the telescopic boom, there is a guying 9 that includes two guy cables 10, each guided from the lower portion of pivot section 2 to the collar of the innermost telescopic section 8. Guy cables 10 are guided over a guy stand 11 that in the embodiment shown is pivoted on the collar of the first telescopic section 5, which is held directly on pivot section 2. As shown in FIG. 2, guy stand 11 has two guy supports 12 that in raised operating position, shown in FIG. 1, are spread apart in a V shape. Each guy support 12 is inclined outward in relation to the vertical luffing plane 13 to form an acute angle $\alpha$ (cf. FIG. 2). The guy supports 12 are housed preferably on just one swivel axle 14 at the top of telescopic section 5 to pivot on telescopic section 5. Pivot axle 19 is inclined in relation to luffing plane 13 in such manner that guy supports 12 can swivel out of transportation position, in which they lie on telescopic boom 1 essentially parallel to each other, as shown in FIG. 3, into the V-shaped spread-open operating position, as shown in FIGS. 1 and 2.

As shown in FIG. 1, in raised operating position the guy supports 12 are inclined not only in relation to luffing plane 13 but also in relation to the cross-sectional plane perpendicular to the longitudinal axis of the telescopic boom at angle $\beta$ shown in FIG. 1. The inclination in relation to cross-sectional plane 15 is selected in such manner that resulting force $F_{res}$ acting from a given guy cable 10 on the given guy support 12 has a lever arm against guy support 12, that is, guy support 12 does not run precisely in the working line of the resulting force $F_{res}$. As shown in FIG. 1, guy cable 10 runs out over guy support 12 and is turned around at its projecting end via a deflection roller 16. The working direction of the resulting force accords with the halving of the angle defined by the two cable segments of the guy cable running together at deflection roller 16. Guy support 10 is thus inclined slightly backward, i.e., inclined toward pivot section 2, so that guy cable 10 tries to press guy support 12 into its transportation position. The corresponding torque is however captured by the pertinent tension rod or stay 17, which on the one hand is pivoted to the pertinent guy support 12 and to the collar of the second telescopic section 6. The slight inclination of guy support 12 to the pivot section ensures that tension rod or stay 17 is always stressed only upon traction. As shown in FIG. 1, tension rod 17 consists of a telescopic pipe the length of which can be adjusted. The two pipe sections of tension rod 17 can be locked together in various extended positions in order to adjust the length of tension rod 17 to various extensions of the telescopic boom.

The two tension rods 17 thus serve simultaneously to raise the two guy supports 12 automatically. As shown in FIG. 3, in transportation position guy stand 11 lies on pivot section 2. The same is true for the two tension rods 17. If telescopic boom 1 is telescoped out of this position, that is, if the first telescopic section 5 moves out of pivot section 2, tension rod 17 is initially moved out along with it. When tension rod 17 reaches its extended target length, it is locked and cannot be extended farther. If telescopic section 5 is then moved farther out of pivot section 2, tension rod 17 is activated and raises guy stand 11. Guy supports 12 swivel on their swivel axle 14. In extended operating position of the telescopic boom according to FIG. 1, the guy supports 12 assume the raised position described before.

Figure 4:
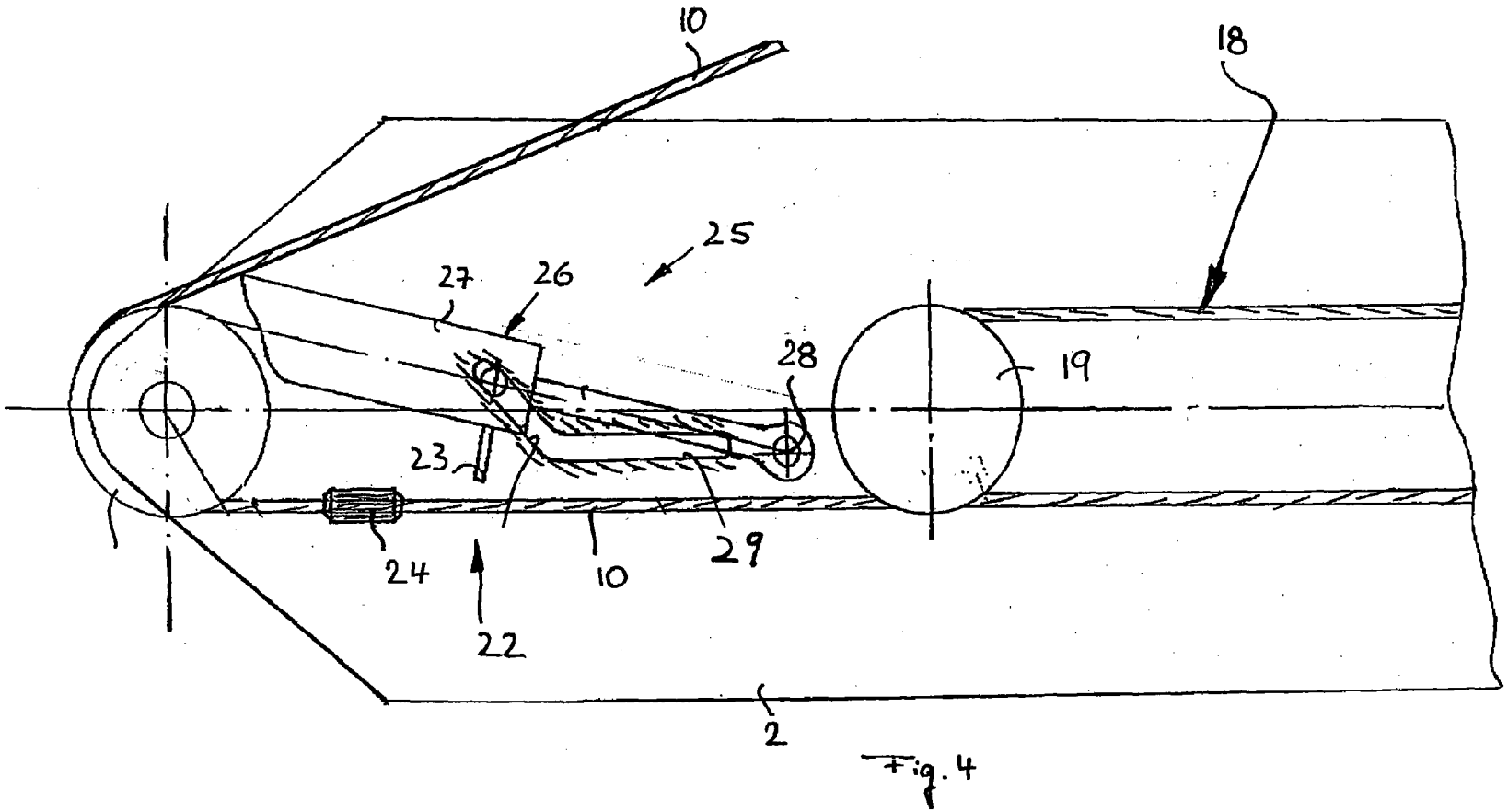
FIG. 4, an enlarged detail view of a hook and eye for locking the guy cable at the lower end of the pivot section.

As is made clear by FIGS. 1 and 4, guy cable 10 is fastened on the one hand to the collar of the innermost telescopic section 8, is led over guy support 12 without being locked onto it, and is finally attached to the lower end of pivot section 2. On pivot section 2 there is a cable storage device 18 into which and out of which a given guy cable 10 can be drawn. Cable storage device 18 consists of a pulley block with several pulleys 19 that are housed on pivot section 2. The pivot-section end of guy cable 10 is connected with an auxiliary cable 20 that is wound on an auxiliary coil 21. In operating position, that is, when guy cable 10 is drawn out of cable storage device 18, auxiliary cable 20 is wound on auxiliary coil 21 and guy cable 10 is drawn through into the pulley block of cable storage device 18. If guy cable is again retracted for transportation of the crane, auxiliary cable 20 is wound on auxiliary coil 21 and guy cable 10 is thereby drawn into the pulley block of cable storage device 18.

However, cable storage device 18 and auxiliary coil 21 do not capture the guy forces. For this purpose there is a hook and eye 22 with which the guy cable can be attached to pivot section 2. Several cable clamps are pressed at intervals onto guy cable 10, which said cable clamps can be captured positively by hook and eye 22. As shown in FIG. 4, hook and eye 22 has a locking piece 23 that can be engaged positively with a given cable clamp 24 pressed onto guy cable 10. Locking piece 23 can thereupon be moved by means of an actuating drive 25, which in the embodiment shown is designed as a hydraulic cylinder 26. The locking piece 23 can be moved on the one hand out of the path of the guy cable or the thickening pieces attached thereto or the cable clamps 24. On the other hand, as soon as locking piece 23 has captured a thickening piece 24, locking piece 23 can be moved in the longitudinal direction of the cable in order to place the guy cable under tension. As shown in FIG. 4, locking piece 23 is attached rigidly to hydraulic cylinder 26, or, more precisely, to the collar section of cylinder 27, from which piston rod 28 projects. Piston rod 28 is jointed at its end to the steel structure of the pivot section so that it can pivot. Cylinder 27 is inserted in a corridor-like guide 29, so that cylinder 27 and locking piece 23 attached thereto travel a predetermined path when the hydraulic cylinder unit 26 is activated.

Guide 29 is designed in such manner that for coupling and uncoupling the locking piece moves crossways to guy cable 10. For stressing, locking piece 23 then moves essentially parallel to the guy cable.

The embodiment according to FIG. 1 shows the guy stand 11 on the collar of the first telescopic section 5. However, it is theoretically possible also to pivot the guy stand on pivot section 2 or on one of the other telescopic sections 6, 7. However, arrangement of the guy stand 11 on the first telescopic section 5 is particularly advantageous in terms of increasing the tractive force.

Figure 5:
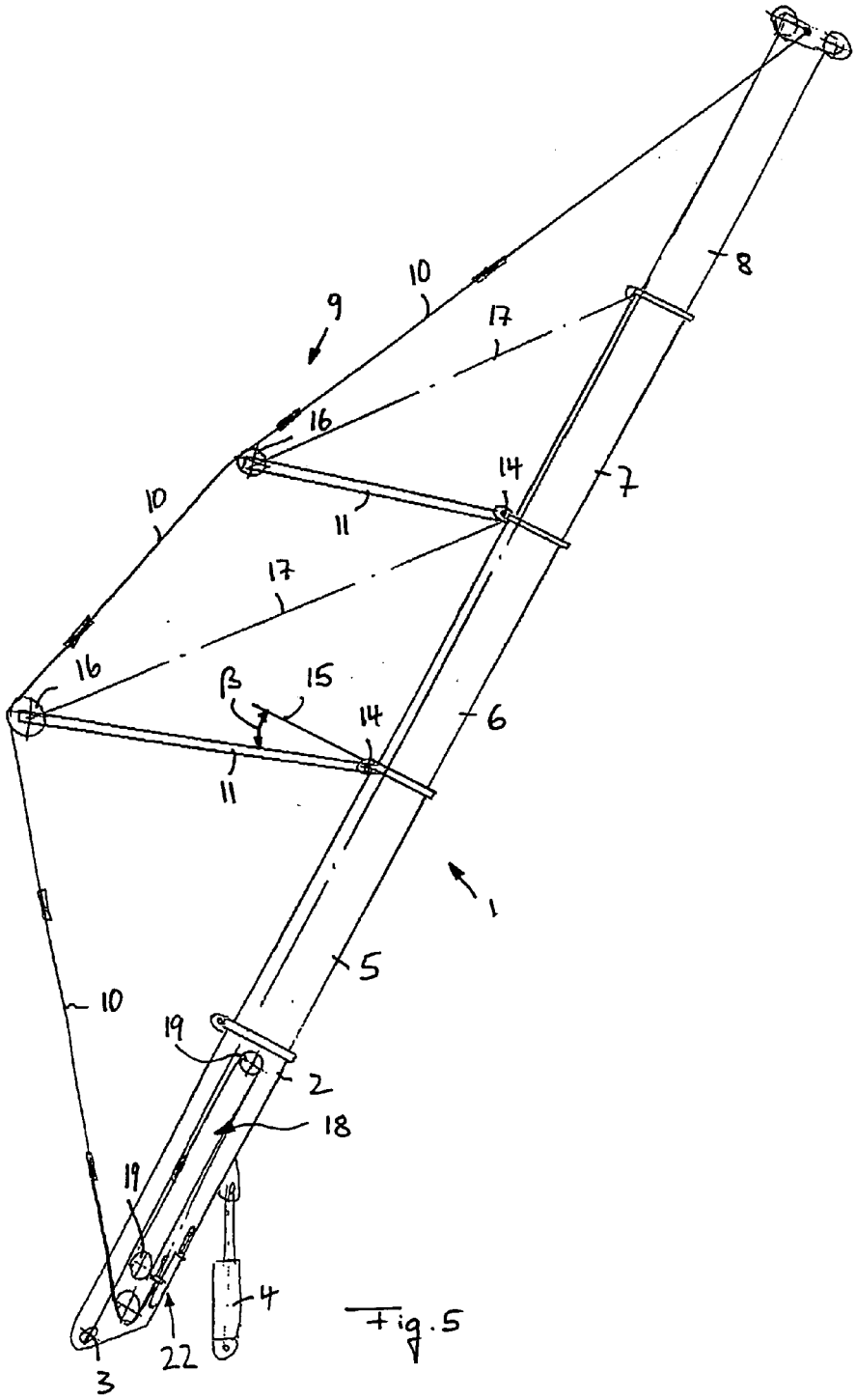
FIG. 5, a schematic side view of a telescopic boom according to another preferred embodiment of the invention, in which the guying has a first guy stand on the first outward-telescoping telescopic section, and a second guy stand on the second outward-telescoping telescopic section.
Figure 6:
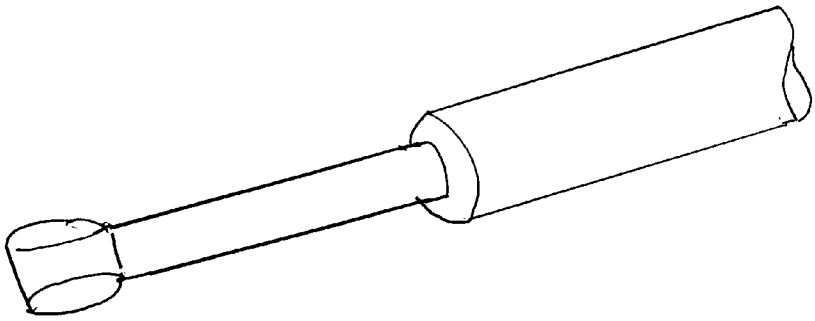
FIG. 6 illustrates a partially-fragmentary, perspective view of a guy stand composed of telescopic section.

Another embodiment according to FIG. 5 differs from the previously described embodiment essentially in that two guy stands 11 are provided. As in the previously described embodiment, the first guy stand 11 sits on the collar of the first telescopic section 5, which is held directly in pivot second 2 and is pivoted by two tension rods 17 on the collar of the second telescopic section 6. The second guy stand 11 is pivoted to swivel on the collar of the said second telescopic section 6, and by means of two tension rods 17 is pivoted on the color of the third telescopic section 7. The V-shaped spread, the swiveling, and the raising of the two guy stands 11 are handled as in the previously described embodiment.

The invention claimed is:

1. Telescopic boom of a crane comprising a pivot section (2) structured and arranged to be pivoted up or down on a horizontal luffing axle (3), telescopic sections (5,6,7,8) concentrically arranged to telescope out of the pivot section (2), a guying (9) having at least one guy stand (11) structured and arranged to pivot on either the pivot section (2) or one telescopic section (5) of the concentric pivoting and telescopic sections (5,6,7,8), at least one guy cable (10) structured and arranged to be supported by the guy stand (11), and erection mechanism (17) for raising the guy stand (11) out of folded transportation position into fully-raised and extended operating position, wherein the erection mechanism comprises a tension rod or stay (17) structured and arranged to terminate at an outer extended end of the guy stand (11) remote from said pivot section (2) or said one telescopic section (5) on which the guy stand (11) is structured and arranged to pivot and connect the guy stand (11) with a telescopic section (6) internally adjacent said pivot section (2) or said one telescopic section (5) on which the guy stand (11) is structured and arranged to pivot, the guy cable (10) runs unattached over the guy stand (11) and terminates at respective attachment points situated upon said pivot section (2) and one (8) of said telescopic sections (5,6,7,8), and in fully raised, extended and operating position, said tension rod or stay (17) extends between said guy stand (11) and guy cable (10) and forms acute angles with each, facing the boom.

2. Telescopic boom according to claim 1, in which the guy stand (11) is inclined, in a fully-open and extended operating position, at an angle (β) with respect to a cross-sectional plane (15) perpendicular to a longitudinal axis of the boom and towards the pivot section (2) in such manner that force induced by the guy cable (10) on the guy stand (11) also induces a tractive force in the tension rod or stay (17).

3. Telescopic boom according to claim 2, in which the attachment point on the pivot section is located on a lower area of the pivot section (2).

4. Telescopic boom according to claim 3, in which the guy stand (11) is pivoted on a collar of a telescopic section (5) of said telescopic sections (5,6,7,8) that is immediately adjacent the pivot section (2).

5. Telescopic boom according to claim 2, in which the guy stand (11) is pivoted on a collar of a telescopic section (5)

of said telescopic sections (5,6,7,8) that is immediately adjacent the pivot section (2).

6. Telescopic boom according to claim 1, in which the guy stand (11) is pivoted on a collar of an intermediate telescopic section (5) of said telescopic sections (5,6,7,8) that is positioned between said pivot section (2) and telescopic section (8) comprising said attachment point.

7. Telescopic boom according to claim 6, in which the tension rod or stay (17) is pivoted on a collar of a telescopic section (6) immediately adjacent the telescopic section (5) on which the guy stand (11) is structured and arranged to swivel or pivot.

8. Telescopic boom according to claim 6, in which the collar is situated upon a telescopic section (5) of said telescopic sections (5,6,7,8) that is immediately adjacent the pivot section (2).

9. Telescopic boom according to claim 1, in which the length of the tension rod or stay (17) can be adjusted.

10. Telescopic boom according to claim 9, in which the tension rod or stay (17) is formed from a telescopic pipe with several extension lengths.

11. Telescopic boom according to claim 1 comprising two said guy cables (10) and tension rods or stays (17), in which the guy stand (11) has two guy supports (12), each structured and arranged to pivot in such a manner that in operating position they are spread apart to form a V, and each of which can be raised into its operating position by means of said respective tension rod or stay (17), and in which said respective guy cable (10) runs over each of the guy supports (12).

12. Telescopic boom according to claim 1, in which the guy stand (11) is changeable in length.

13. Telescopic boom according to claim 12, in which the guy stand (11) is structured and arranged to be telescoped.

14. Telescopic boom according to claim 1, comprising several guy stands (11) pivoted to several sections (5, 6) of the telescopic sections (5,6,7,8) that can telescope into one another.

15. Telescopic boom according to claim 1, in which the guy cable (10) or each guy cable (10) can be drawn out and into a cable storage device (18) and by a hook and eye (22) can be locked in a desired cable length.

16. Telescopic boom according to claim 15, in which there are several thickening pieces (24) positioned at intervals on the guy cable (10) and the hook and eye (22) has a mobile locking piece (23) that allows one or more of the thickening pieces (24) to run through, or which captures one of the thickening pieces (24).

17. Telescopic boom according to claim 15, in which the hook and eye (22) can move by a hook and eye drive (25) in the longitudinal direction of the cable, and the guy cable (10) can be placed under tension by the movement of the hook and eye (22).

18. Telescopic boom according to claim 17, wherein the hook and eye drive (25) includes an hydraulic cylinder (26).

19. Telescopic boom according to claim 15, in which the hook and eye (22) and/or the cable storage device (18) are on the pivot section (2).

20. Telescopic boom according to claim 15, in which the cable storage device (18) has at least one storage pulley (19) into which the guy cable (10) can be drawn and/or in which an auxiliary cable (20) for hauling in the guy cable is attached at the end of the guy cable (10).

21. Telescopic boom according to claim 15, in which the guy cable or each guy cable (10) has, at its end, thickening pieces (24) structured and arranged to engage positively with the hook and eye (22).

22. Telescopic boom according to claim 15, wherein the thickening pieces (24) are pressed-on clamps.

* * * * *